US006405398B1

(12) United States Patent
Seidel

(10) Patent No.: US 6,405,398 B1
(45) Date of Patent: Jun. 18, 2002

(54) BABY BOTTLE SCRUBBING DEVICE

(76) Inventor: Mary C. Seidel, 200 Stonehaven Dr., Edinboro, PA (US) 16412

( * ) Notice: Subject to any disclaimer, the term of this patent is extended or adjusted under 35 U.S.C. 154(b) by 0 days.

(21) Appl. No.: 09/663,158

(22) Filed: Sep. 15, 2000

(51) Int. Cl.[7] ..... A47L 15/00; B08B 9/36
(52) U.S. Cl. ..... 15/59; 15/76
(58) Field of Search ..... 15/59, 65–67, 15/74–76

(56) References Cited

U.S. PATENT DOCUMENTS 2,242,361 A * 5/1941 Lewis
2,639,451 A * 5/1953 Ford
3,092,863 A * 6/1963 Linnit
3,638,268 A 2/1972 Van Horn
3,781,939 A 1/1974 Qualheim
D265,201 S 6/1982 Salem
5,315,729 A * 5/1994 Yang
5,488,747 A 2/1996 Woodhouse
5,507,060 A 4/1996 Quimpo
5,709,003 A 1/1998 Batch
5,903,944 A * 5/1999 Burrell

* cited by examiner

*Primary Examiner*—Terrence R. Till

(57) ABSTRACT

A baby bottle scrubbing device for automating the task of washing baby bottles and the supporting nipples. The baby bottle scrubbing device includes a housing having a top wall and a bottom wall and further having a plurality of feet members securely attached to the bottom wall thereof for securing the housing upon a surface and also having openings extending through the top wall thereof; and also includes a scrubbing assembly for scrubbing a baby bottle including a nipple removably attached to the baby bottle.

18 Claims, 3 Drawing Sheets

BABY BOTTLE SCRUBBING DEVICE

BACKGROUND OF THE INVENTION

1. Field of the Invention

The present invention relates to an automatic baby bottle and nipple scrubber and more particularly pertains to a new baby bottle scrubbing device for automating the task of washing baby bottles and the supporting nipples.

2. Description of the Prior Art

The use of an automatic baby bottle and nipple scrubber is known in the prior art. More specifically, an automatic baby bottle and nipple scrubber heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,507,060; U.S. Pat. No. 3,638,268; U.S. Pat. No. 3,781,939; U.S. Pat. No. 5,709,003; U.S. Pat. No. 5,488,747; and U.S. Pat. No. Des. 265,201.

While these devices fulfill their respective, particular objectives and requirements, the aforementioned patents do not disclose a new baby bottle scrubbing device. The inventive device includes a housing having a top wall and a bottom wall and further having a plurality of feet members securely attached to the bottom wall thereof for securing the housing upon a surface and also having openings extending through the top wall thereof; and also includes a scrubbing assembly for scrubbing a baby bottle including a nipple removably attached to the baby bottle.

In these respects, the baby bottle scrubbing device according to the present invention substantially departs from the conventional concepts and designs of the prior art, and in so doing provides an apparatus primarily developed for the purpose of automating the task of washing baby bottles and the supporting nipples.

SUMMARY OF THE INVENTION

In view of the foregoing disadvantages inherent in the known types of automatic baby bottle and nipple scrubber now present in the prior art, the present invention provides a new baby bottle scrubbing device construction wherein the same can be utilized for automating the task of washing baby bottles and the supporting nipples.

The general purpose of the present invention, which will be described subsequently in greater detail, is to provide a new baby bottle scrubbing device which has many of the advantages of the automatic baby bottle and nipple scrubber mentioned heretofore and many novel features that result in a new baby bottle scrubbing device which is not anticipated, rendered obvious, suggested, or even implied by any of the prior art automatic baby bottle and nipple scrubber, either alone or in any combination thereof.

To attain this, the present invention generally comprises a housing having a top wall and a bottom wall and further having a plurality of feet members securely attached to the bottom wall thereof for securing the housing upon a surface and also having openings extending through the top wall thereof; and also includes a scrubbing assembly for scrubbing a baby bottle including a nipple removably attached to the baby bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baby bottle scrubbing device which has many of the advantages of the automatic baby bottle and nipple scrubber mentioned heretofore and many novel features that result in a new baby bottle scrubbing device which is not anticipated, rendered obvious, suggested, or even implied by any of the prior art automatic baby bottle and nipple scrubber, either alone or in any combination thereof.

It is another object of the present invention to provide a new baby bottle scrubbing device which may be easily and efficiently manufactured and marketed.

It is a further object of the present invention to provide a new baby bottle scrubbing device which is of a durable and reliable construction.

An even further object of the present invention is to provide a new baby bottle scrubbing device which is susceptible of a low cost of manufacture with regard to both materials and labor, and which accordingly is then susceptible of low prices of sale to the consuming public, thereby making such baby bottle scrubbing device economically available to the buying public.

Still yet another object of the present invention is to provide a new baby bottle scrubbing device which provides in the apparatuses and methods of the prior art some of the advantages thereof, while simultaneously overcoming some of the disadvantages normally associated therewith.

Still another object of the present invention is to provide a new baby bottle scrubbing device for automating the task of washing baby bottles and the supporting nipples.

Yet another object of the present invention is to provide a new baby bottle scrubbing device which includes a housing having a top wall and a bottom wall and further having a plurality of feet members securely attached to the bottom wall thereof for securing the housing upon a surface and also having openings extending through the top wall thereof; and also includes a scrubbing assembly for scrubbing a baby bottle including a nipple removably attached to the baby bottle.

Still yet another object of the present invention is to provide a new baby bottle scrubbing device that saves the user substantial time in cleaning and scrubbing the bottles and the nipples.

Even still another object of the present invention is to provide a new baby bottle scrubbing device that is easy and convenient to use and place within water in a sink basin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
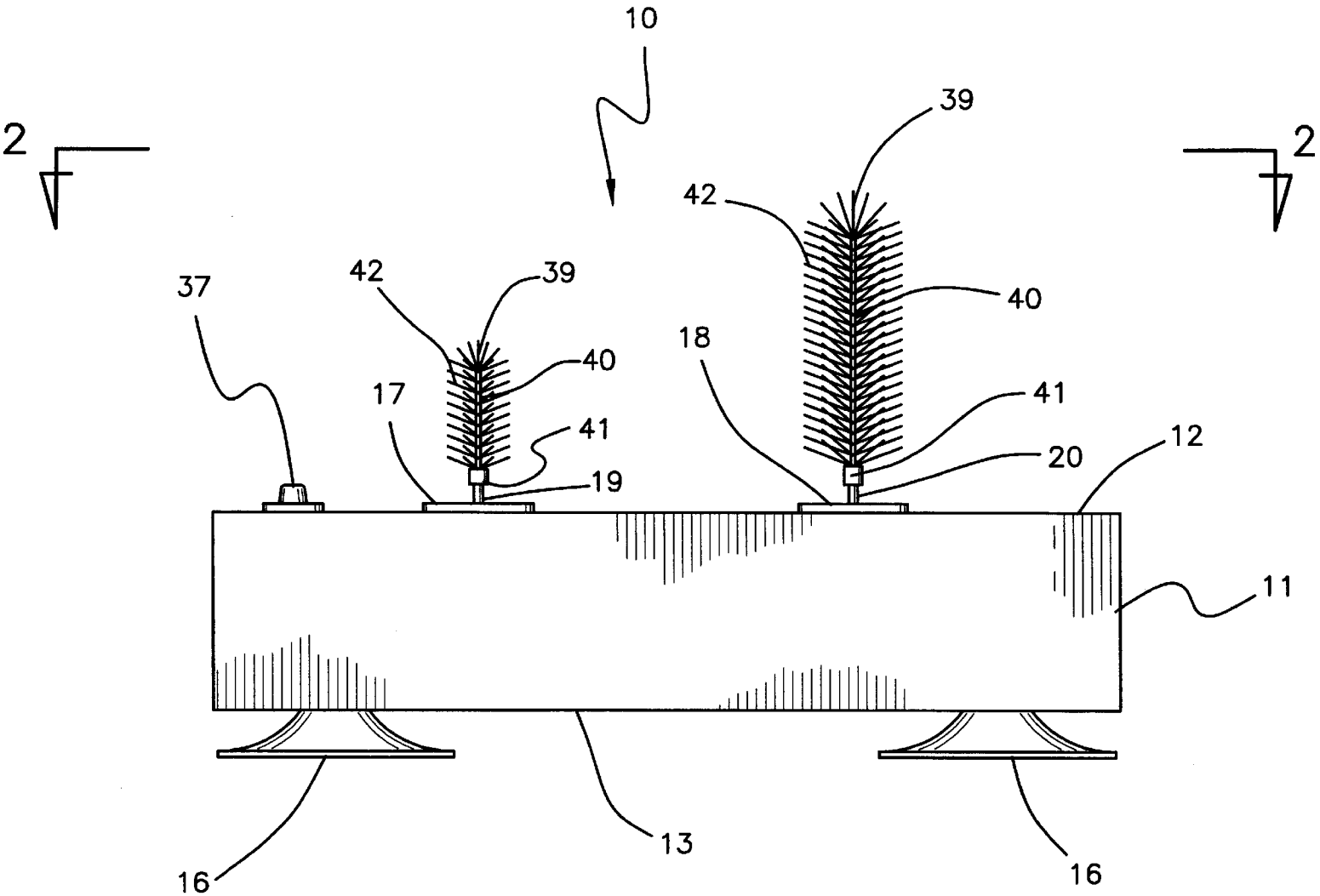
FIG. 1 is a side elevational view of a new baby bottle scrubbing device according to the present invention.
Figure 2:
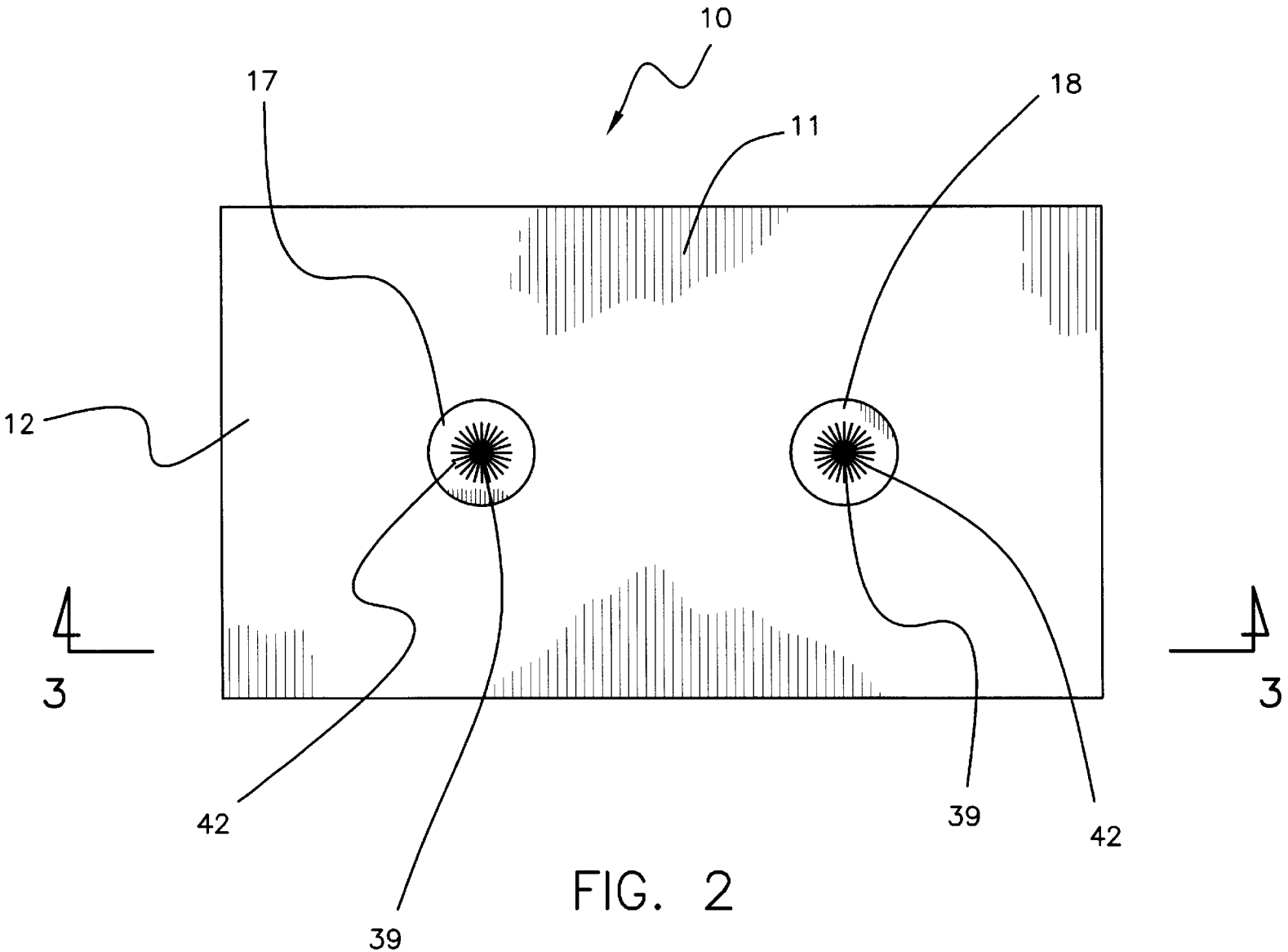
FIG. 2 is a top plan view of the present invention.
Figure 3:
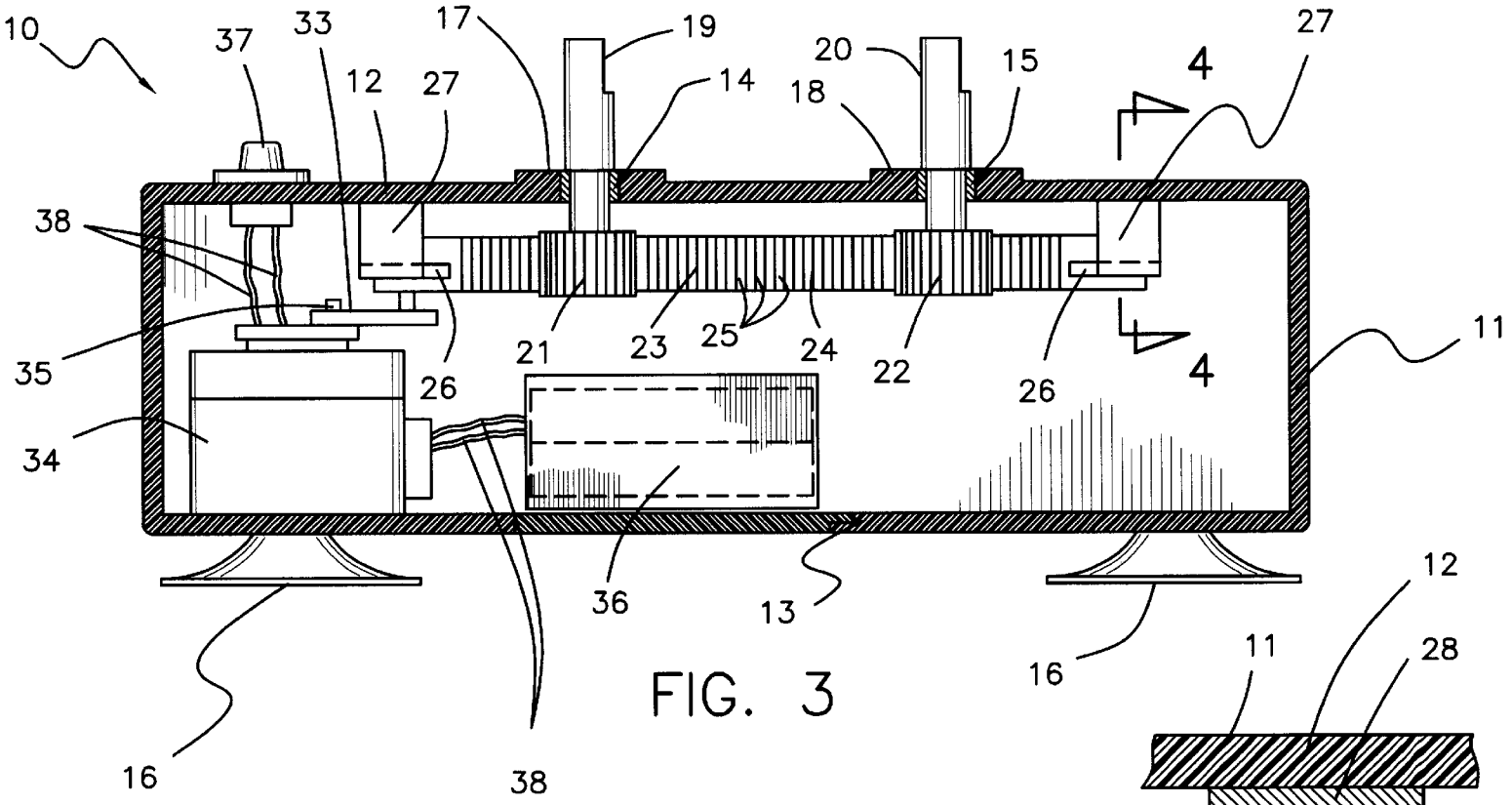
FIG. 3 is a cross-sectional view of the housing of the present invention.
Figure 4:
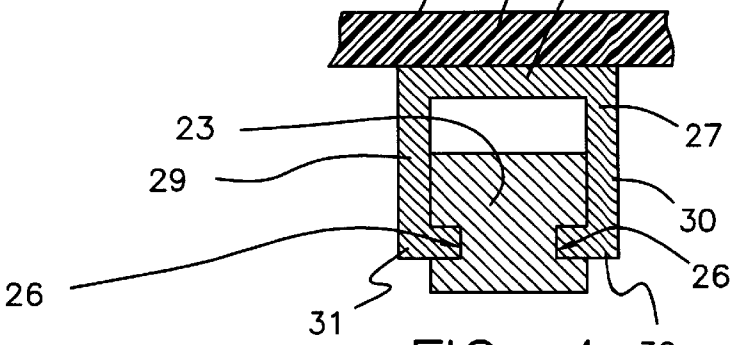
FIG. 4 is a cross-sectional view of an end of the elongate drive member and one of the bracket members of the present invention.

With reference now to the drawings, and in particular to FIGS. 1 through 4 thereof, a new baby bottle scrubbing device embodying the principles and concepts of the present invention and generally designated by the reference numeral 10 will be described.

As best illustrated in FIGS. 1 through 4, the baby bottle scrubbing device 10 generally comprises a housing 11 having a top wall 12 and a bottom wall 13 and further having a plurality of feet members 16 securely and conventionally attached to the bottom wall 13 thereof for securing the housing 11 upon a surface and also having openings 14,15 extending through the top wall 12 thereof. The housing 11 has length of approximately 6 ½ inches and height of approximately 2 inches and a width of approximately 2 ½ inches.

Means for scrubbing a baby bottle including a nipple removably attached to the baby bottle includes support shafts 19,20 each being rotatably and securely extended through a respective opening 14,15 in the top wall 12 of the housing 11, and also includes seal members 17,18 securely and conventionally disposed about edges of the openings 14,15 to substantially seal the housing 11, and further includes gear members 21,22 securely and conventionally mounted to bottom ends of the support shafts 19,20 and being disposed within the housing 11, and also includes an elongate drive member 23 being movably mounted within the housing 11 near the top wall 12 thereof and being engageable to the gear members 21,22, and further includes a motor 34 having a motor shaft 35 and being securely and conventionally disposed within the housing 11, and also includes a battery 36 connected to the motor 34 with wires 38 and being conventionally disposed within the housing 11, and further includes an on/off switch 37 securely and conventionally disposed in the top wall 12 of the housing 11 and being connected to the motor 34 with wires 37 for energizing the motor 34, and also includes a linkage member 33 conventionally attached to the motor shaft 35 and to the elongate drive member 23, and further includes scrubbing members 39 being removably mounted upon the support shafts 19,20, and also includes means for supporting the elongate drive member 23 with the elongate drive member 23 having a plurality of teeth 25 being spaced apart and being conventionally disposed in and along a side wall 24 thereof for engaging and rotating the gear members 21,22. The elongate drive member 23 has grooves 26 extending in opposite sides thereof and extending along end portions of the sides. Each of the support shafts 19,20 has a longitudinal portion of an upper portion being cutaway relative to a main portion of the support shaft 19,20. Each of the scrubbing members 39 includes a stem 40 having a bottom end; a coupler 41 conventionally mounted to the bottom end of the stem 40 for securely and removably mounting to an upper portion of a respective support shaft 19,20; and a plurality of bristle-like members 42 being securely and conventionally attached to and extending outwardly from the stem 40 and extending along a length thereof for scrubbing an inside of the baby bottle and also a nipple for the baby bottle. The means for supporting the elongate drive member 23 includes bracket members 27 each having a main wall 28 which is securely and conventionally attached to an interior of the top wall 12 of the housing 11, and also includes side walls 29,30 which are securely and conventionally attached at opposite sides of the main wall 28 and which extend outwardly therefrom, and further includes flange members 31,32 being attached to ends of the side walls 29,30 and extending toward one another with a space being in between thereof. The flange members 31,32 are received in the grooves 26 of the elongate drive member 23 with the elongate drive member 23 being movable upon the flange members 31,32. One of the support shafts 19 is relatively shorter than the other of the support shafts 20 with one support shaft 19 having length of approximately 1 ½ inches and with the other support shaft 20 having a length of approximately 2 ½ inches.

In use, the user places the baby bottle scrubbing device 10 in water preferably in a sink basin and energizes the motor 34 by turning on the on/off switch 37 which rotates and oscillates the scrubbing members 39. The user places the baby bottles about the scrubbing members 39 to effectively clean and scrub the insides thereof and also uses the scrubbing members 39 to effectively clean and scrub the nipples inside and out.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baby bottle scrubbing device comprising:

a housing having a top wall and a bottom wall and further having a plurality of feet members securely attached to said bottom wall thereof for securing said housing upon a surface and also having openings extending through said top wall thereof; and means for scrubbing a baby bottle including a nipple removably attached to the baby bottle;

wherein said means for scrubbing a baby bottle including a nipple includes support shafts each being rotatably extended through a respective said opening in said top wall of said housing, and also includes seal members securely disposed about edges of said openings to substantially seal said housing, and further includes gear members securely mounted to bottom ends of said support shafts and being disposed within said housing, and also includes an elongate drive member being movably mounted within said housing near said top wall thereof and being engageable to said gear members, and further includes a motor having a motor shaft and being securely disposed within said housing, and also includes a battery connected to said motor with wires, and further includes an on/off switch securely disposed in said top wall of said housing and being connected to said motor with wires for energizing said motor, and also includes a linkage member attached to said motor shaft and to said elongate drive member, and further includes scrubbing members being removably mounted upon said support shafts, and also includes means for supporting said elongate drive member.

2. A baby bottle scrubbing device as described in claim 1, wherein said elongate drive member has a plurality of teeth being spaced apart and being disposed upon and along a side wall thereof for engaging and rotating said gear members.

3. A baby bottle scrubbing device as described in claim 1, wherein said elongate drive member has grooves extending in opposite sides thereof and extending along end portions of said sides.

4. A baby bottle scrubbing device as described in claim 1, wherein each of said support shafts has a longitudinal portion of an upper portion being cutaway relative to a main portion of said support shaft.

5. A baby bottle scrubbing device as described in claim 1, wherein each of said scrubbing members includes a stem having a bottom end; a coupler mounted to said bottom end of said stem for securely and removably mounting to a respective said support shaft; and a plurality of bristle members being securely attached to and extending outwardly from said stem and extending along a length thereof for scrubbing an inside of the baby bottle and also a nipple for the baby bottle.

6. A baby bottle scrubbing device as described in claim 3, wherein said means for supporting said elongate drive member includes bracket members each having a main wall which is securely attached to an interior of said top wall of said housing, and also including side walls which are securely attached at opposite sides of said main wall and which extend outwardly therefrom, and further including flange members being attached to ends of said side walls and extending toward one another with a space being in between thereof, said flange members being received in said grooves of said elongate drive member.

7. A baby bottle scrubbing device comprising:

a housing having a top wall and a bottom wall and further having a plurality of feet members securely attached to said bottom wall thereof for securing said housing upon a surface* and also having openings extending through said top wall thereof, said housing having length of approximately 6 ½ inches and height of approximately 2 inches and a width of approximately 2 ½ inches; and means for scrubbing a baby bottle including a nipple removably attached to the baby bottle having a nipple including support shafts each being rotatably extended through a respective said opening in said top wall of said housing, and also including seal members securely disposed about edges of said openings to substantially seal said housing, and further including gear members securely mounted to bottom ends of said support shafts and being disposed within said housing, and also including an elongate drive member being movably mounted within said housing near said top wall thereof and being engageable to said gear members, and further including a motor having a motor shaft and being securely disposed within said housing, and also including a battery connected to said motor with wires, and further includes an on/off switch securely disposed in said top wall of said housing and being connected to said motor with wires for energizing said motor, and also including a linkage member attached to said motor shaft and to said elongate drive member, and further including scrubbing members being removably mounted upon said support shafts, and also including means for supporting said elongate drive member, said elongate drive member having a plurality of teeth being spaced apart and being disposed upon and along a side wall thereof for engaging and rotating said gear members, said elongate drive member having grooves extending in opposite sides thereof and extending along end portions of said sides, each of said support shafts having a longitudinal portion of an upper portion being cutaway relative to a main portion of said support shaft, each of said scrubbing members including a stem having a bottom end; a coupler mounted to said bottom end of said stem for securely and removably mounting to a respective said support shaft; and a plurality of bristle-like members being securely attached to and extending outwardly from said stem and extending along a length thereof for scrubbing an inside of the baby bottle and also a nipple for the baby bottle, said means for supporting said elongate drive member including bracket members each having a main wall which is securely attached to an interior of said top wall of said housing, and also including side walls which are securely attached at opposite sides of said main wall and which extend outwardly therefrom, and further including flange members being attached to ends of said side walls and extending toward one another with a space being in between thereof, said flange members being received in said grooves of said elongate drive member, one of said support shafts being relatively shorter than the other of said support shafts with one said support shaft having length of approximately 1 ½ inches and with the other said support shaft having a length of approximately 2 ½ inches.

8. A baby bottle scrubbing device comprising:

a housing having a top wall and a bottom wall, said housing having openings extending through said top wall thereof; and scrubbing means for scrubbing a baby bottle;

wherein said scrubbing means includes: support shafts each being rotatably extended through a respective one of said openings; seal members disposed about edges of said openings to substantially seal said housing; and gear members mounted on bottom ends of said support shafts and being disposed in said housing.

9. A baby bottle scrubbing device as described in claim 8, wherein said scrubbing means includes an elongate drive member being movably mounted in said housing and being engageable to said gear members.

10. A baby bottle scrubbing device as described in claim 9, wherein said elongate drive member has a plurality of teeth being spaced apart and being disposed upon and along a side wall thereof for engaging and rotating said gear members.

11. A baby bottle scrubbing device as described in claim 9, wherein said elongate drive member has grooves extending in opposite sides thereof and extending along end portions of said sides.

12. A baby bottle scrubbing device as described in claim 9, additionally comprising means for supporting said elongate drive member that includes bracket members each having a main wall attached to an interior of said housing, side walls attached at opposite sides of said main wall and which extend outwardly therefrom, and flange members being attached to ends of said side walls and extending toward one another with a space being in between thereof, said flange members being received in grooves of said elongate drive member.

13. A baby bottle scrubbing device as described in claim 8, wherein said scrubbing means includes a motor having a motor shaft and being mounted in said housing.

14. A baby bottle scrubbing device as described in claim 13, wherein said scrubbing means includes a battery electrically connected to said motor, and an on/off switch mounted on said housing and being connected to said motor for energizing said motor.

15. A baby bottle scrubbing device as described in claim 13, wherein said scrubbing means includes an elongate drive member being movably mounted in said housing and being engageable to said gear members, a motor having a motor shaft and being mounted in said housing, and a linkage member attached to said motor shaft and to said elongate drive member.

16. A baby bottle scrubbing device as described in claim 13, wherein said scrubbing means includes scrubbing members being removably mounted upon said support shafts.

17. A baby bottle scrubbing device as described in claim 16, wherein each of said scrubbing members includes a stem having a bottom end; a coupler mounted to said bottom end of said stem for removably mounting to a respective said support shaft; and a plurality of bristle members attached to and extending outwardly from said stem and extending along a length thereof for scrubbing an inside of the baby bottle.

18. A baby bottle scrubbing device as described in claim 8, wherein each of said support shafts has a longitudinal portion of an upper portion being cutaway relative to a main portion of said support shaft.

* * * * *